US009074162B1

(12) United States Patent
Silvernail et al.

(10) Patent No.: US 9,074,162 B1
(45) Date of Patent: Jul. 7, 2015

(54) DETERGENT COMPOSITIONS COMPRISING VINYLIDENE DIPHOSPHONIC ACID POLYMERS

(71) Applicant: ECOLAB USA INC., St. Paul, MN (US)

(72) Inventors: Carter M. Silvernail, Burnsville, MN (US); Monique Roerdink-Lander, Eagan, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/175,439

(22) Filed: Feb. 7, 2014

(51) Int. Cl.

| | |
|---|---|
| ***C11D 1/66*** | (2006.01) |
| ***C11D 3/10*** | (2006.01) |
| ***B08B 3/04*** | (2006.01) |
| ***C11D 3/37*** | (2006.01) |
| ***C11D 3/00*** | (2006.01) |

(52) U.S. Cl.
CPC ..... *C11D 3/378* (2013.01); *C11D 3/0036* (2013.01)

(58) Field of Classification Search
CPC ..... C11D 3/044; C11D 3/10; C11D 3/3757; C11D 3/378; C11D 3/3784; C11D 1/66; B08B 3/04
USPC ..... 510/223, 225, 230, 233, 252, 272, 467, 510/475, 477, 478, 492, 509; 134/25.2, 134/25.3, 39, 42
See application file for complete search history.

(56) References Cited

U.S. PATENT DOCUMENTS

| | | | |
|---|---|---|---|
| 3,544,509 | A | 12/1970 | Carroll et al. |
| 3,576,793 | A | 4/1971 | Carroll et al. |
| 3,686,290 | A | 8/1972 | Carroll |
| 4,427,765 | A | 1/1984 | Mohr et al. |
| 5,332,531 | A | 7/1994 | Horwitz et al. |
| 5,386,038 | A | 1/1995 | Davis et al. |
| 5,449,462 | A | 9/1995 | Horwitz et al. |
| 5,539,003 | A | 7/1996 | Horwitz et al. |
| 5,678,242 | A | 10/1997 | Horwitz et al. |
| 5,980,776 | A | 11/1999 | Zakikhani et al. |
| 6,030,710 | A | 2/2000 | Nitowski et al. |
| 6,071,434 | A | 6/2000 | Davis et al. |
| 6,120,618 | A | 9/2000 | Opalka |
| 6,218,075 | B1 | 4/2001 | Kimura et al. |
| 7,572,381 | B2 | 8/2009 | Talbot et al. |
| 7,674,382 | B2 | 3/2010 | Musale |
| 7,902,137 | B2 | 3/2011 | Kneipp et al. |
| 7,915,204 | B2 | 3/2011 | De Campo et al. |
| 8,003,575 | B2 | 8/2011 | De Campo et al. |
| 2006/0097229 | A1 | 5/2006 | Grech et al. |
| 2007/0062879 | A1* | 3/2007 | Talbot et al. ..... 210/699 |
| 2009/0036637 | A1 | 2/2009 | Otter et al. |
| 2009/0065433 | A1 | 3/2009 | Hails et al. |
| 2009/0163389 | A1 | 6/2009 | De Campo et al. |
| 2009/0294374 | A1 | 12/2009 | Gill et al. |
| 2010/0139705 | A1 | 6/2010 | Oberlander |
| 2010/0317559 | A1 | 12/2010 | Ryther et al. |
| 2012/0032093 | A1 | 2/2012 | Moore et al. |
| 2013/0005639 | A1 | 1/2013 | Miralles et al. |
| 2013/0018099 | A1 | 1/2013 | McSerry |
| 2013/0165572 | A1 | 6/2013 | Scheuing et al. |

FOREIGN PATENT DOCUMENTS

| | | | |
|---|---|---|---|
| CA | 856193 | A | 11/1970 |
| DE | 33 05 355 | A1 | 8/1984 |
| EP | 0 491 391 | A1 | 6/1992 |
| EP | 0 569 731 | A2 | 11/1993 |
| EP | 0 626 273 | A1 | 11/1994 |
| EP | 0 705 892 | A2 | 4/1996 |
| EP | 0 707 051 | A1 | 4/1996 |
| EP | 0 780 406 | A2 | 6/1997 |
| EP | 1 000 768 | A2 | 5/2000 |
| GB | 2 279 953 | A | 1/1995 |
| GB | 2 310 663 | A | 9/1997 |
| GB | 2 331 942 | A | 6/1999 |
| WO | WO 90/05115 | A1 | 5/1990 |
| WO | WO 95/09086 | A1 | 4/1995 |
| WO | WO 2010/057977 | A1 | 5/2010 |
| WO | WO 2012/098186 | A1 | 7/2012 |
| WO | WO 2013/110349 | A1 | 8/2013 |

* cited by examiner

*Primary Examiner* — Brian P Mruk
(74) *Attorney, Agent, or Firm* — McKee, Voorhees & Sease, PLC

(57) ABSTRACT

Methods employing detergent compositions effective for reducing soil redeposition and accumulation on hard surfaces are disclosed. The alkaline detergent compositions employ vinylidene diphosphonic acid polymers, including unsaturated monocarboxylic acid polymers with a phosphonate end group, preferably a vinylidene diphosphonic acid end group, in combination with an alkali metal hydroxide or other alkalinity source. The alkaline detergent compositions preferably further employ threshold agents. The alkaline detergent compositions reduce the amount of phosphorus-containing materials and polyacrylate materials required for water conditioning, soil removal and soil antiredeposition.

20 Claims, No Drawings

DETERGENT COMPOSITIONS COMPRISING VINYLIDENE DIPHOSPHONIC ACID POLYMERS

FIELD OF THE INVENTION

The invention relates to detergent compositions and methods employing detergent compositions containing unsaturated monocarboxylic acid polymers with a phosphonate end group, preferably a vinylidene diphosphonic acid end group, for controlling hard water scale and preventing soil redeposition on hard surfaces. The detergent compositions employ polymers and/or copolymers with vinylidene diphosphonic acid end groups, in combination with an alkalinity source and preferably threshold agents, including for example, phosphonates, polymers and/or copolymers of acrylic acid and maleic acids or salts thereof. The detergent compositions reduce the concentrations of threshold agent polymers, such as polyacrylates, employed therein while providing desirable hard water scaling control. Beneficially, methods employing the detergent compositions prevent and/or minimize hard water scaling and soil redeposition on hard surfaces in alkaline conditions between about 9 and 12.5.

BACKGROUND OF THE INVENTION

Detergent formulations employing alkali metal carbonates and/or alkali metal hydroxides are known to provide effective detergency. As the use of phosphorous raw materials in detergents becomes more heavily regulated, industries are seeking alternative ways to control hard water scale formation associated with highly alkaline detergents. Many commercially-available detergent formulations have employed sodium tripolyphosphate as a cost effective warewashing detergent component for controlling hard water scale and similar benefits. However, as formulations are adapted to contain less than 0.5 wt-% phosphorus, there is a need for identifying replacement water conditioning and cleaning components. However, many non-phosphate replacement formulations result in heavy soil accumulation on hard surfaces such as glass, plastic, rubber and/or metal surfaces.

Therefore, there is a need for detergent compositions, such as ware washing compositions, to provide adequate cleaning performance and preventing hard water scale accumulation while minimizing soil redeposition on a hard surfaces in contact with the detergent compositions. Such hard surfaces may include, for example, the interior parts of a warewash machine or kitchenware such as glass, metal, rubber or plastic substrates. Suitable kitchenware includes, but is not limited to cake pans, baking sheets, molds, loaf pans, muffin pans, pie pans, measuring cups/spoons, saucers, servers, gravy boats, serving bowls, platters, butter dishes, tureens, griddles, glasses, cups, plates, bowls, pots, pans, kitchen utensils and the like. Similarly, there is a need for methods of reducing soil accumulation on a hard surface that avoids the use of phosphates.

Accordingly, it is an objective of the claimed invention to develop alkaline detergent compositions effective for reducing and/or substantially eliminating scale build up on hard surfaces while maintaining effective detergency.

A further object of the invention is to provide methods for employing alkaline detergents between pHs from about 9 to about 12.5 minimizing soil accumulation on hard surfaces.

A still further object of the invention is to employ alkaline detergents containing polymers and/or copolymers having vinylidene diphosphonic acid end groups for improved control against hard water scale and preventing soil accumulation on hard surfaces.

A still further object of the invention is to employ alkaline detergents containing vinylidene diphosphonic acid polymers, optionally in combination with threshold agent polymers, such as phosphonates, polymaleic acids, polyacrylic acids, or other polyacrylates, wherein the use concentration of the threshold agents is reduced due to the formulation with the vinylidene diphosphonic acid polymers.

BRIEF SUMMARY OF THE INVENTION

The following invention is advantageous for minimizing soil and hard water scale accumulation on hard surfaces. As a result, the aesthetic appearances of the treated substrate surfaces are improved and/or the condition of the hard surfaces contacted by the detergent compositions, such as the parts of a ware wash machine, have decreased accumulation, build up and/or discoloration.

In an embodiment, a detergent composition comprises an alkalinity source selected from alkali metal carbonate and alkali metal hydroxide, and a polymer with the following structure:

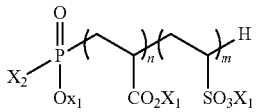

where in $X_1$ is selected from $Na^+$ and $K^+$ and the mole ratio of n:m is from about 5:1 to about 1:5 and $X_2$ has the following structure:

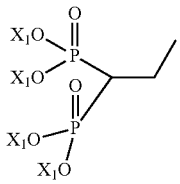

In an aspect, a use solution of the detergent composition has a pH between about 9 and 12.5.

In an embodiment, a detergent composition comprises a polymer with the following structure:

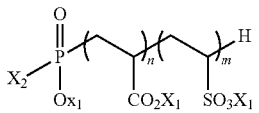

where in $X_1$ is selected from $Na^+$ and $K^+$ and the mole ratio of n:m is from about 5:1 to about 1:5 and $X_2$ has the following structure:

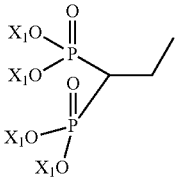

an alkali metal hydroxide and/or alkali metal carbonate alkalinity source, a threshold agent, and water. In an aspect, the use solution of the detergent composition has a pH between about 9 and 12.5.

In a further embodiment, a method of reducing soil accumulation on a hard surface comprises contacting a hard surface with a detergent composition comprising an unsaturated monocarboxylic acid polymer with vinylidene diphosphonic acid end group, an alkali metal hydroxide alkalinity source, a threshold agent, and water, and reducing and/or preventing soil accumulation on the hard surface. In an aspect, the use solution of the detergent composition has a pH between about 9 and 12.5. In a further aspect, the detergent composition has less than 0.5 wt-% phosphorus, or optionally does not include use of phosphates.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The present invention relates to alkaline detergent compositions that reduce the amount of polyacrylate polymers required for controlling hard water scale and preventing soil redeposition on hard surfaces. The detergent compositions employ vinylidene diphosphonic acid polymers with an alkalinity source, such as alkali metal hydroxides and/or carbonates. The detergent compositions may further include a threshold agent compound selected from the group consisting of phosphonates, polymers, copolymers and/or homopolymers of acrylic and maleic acids or salts thereof (e.g. polymaleic acid, polyacrylic acid) and combinations thereof for further improved control of hard water scale and prevention of soil redeposition on hard surfaces. The detergent compositions and methods of use thereof have many advantages over conventional alkaline detergents. For example, the detergent compositions minimize soil and hard water scale accumulation on hard surfaces under alkaline conditions from about 9 to about 12.5, while decreasing the concentration of polyacrylate polymers required and reducing the phosphorous content of the detergent composition.

The embodiments of this invention are not limited to particular alkaline detergent compositions, and methods of using the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

The term "cleaning," as used herein, refers to performing or aiding in any soil removal, bleaching, microbial population reduction, or combination thereof.

The term "water" as used herein, refers to any source of water that can be used with the methods and compositions of the present invention. Water sources suitable for use in the present invention include a wide variety of both quality and pH, and include but are not limited to, city water, well water, water supplied by a municipal water system, water supplied by a private water system, and/or water directly from the system or well. Water can also include water from a used water reservoir, such as a recycle reservoir used for storage of recycled water, a storage tank, or any combination thereof. Water also includes food process or transport waters. It is to be understood that regardless of the source of incoming water for systems and methods of the invention, the water sources may be further treated within a manufacturing plant. For example, lime may be added for mineral precipitation, carbon filtration may remove odoriferous contaminants, additional chlorine or chlorine dioxide may be used for disinfection or water may be purified through reverse osmosis taking on properties similar to distilled water.

As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism. For the purpose of this patent application, successful microbial reduction is achieved when the microbial populations are reduced by at least about 50%, or by significantly more than is achieved by a wash with water. Larger reductions in microbial population provide greater levels of protection.

As used herein, the term "phosphate-free" or "substantially phosphate-free" refers to a composition, mixture, or ingredient that does not contain phosphates or phosphate-containing compounds or to which phosphate or phosphate-containing compound has not been added. Should phosphorus or a phosphorus-containing compound be present, including for example the use of polymers and/or copolymers with vinylidene diphosphonic acid end groups, the amount of phosphorus in the detergent composition shall be less than 0.5 wt-% phosphorus. More preferably, the amount of phosphorus is less than 0.1 wt-%, and most preferably the amount of phosphorus is less than 0.01 wt-%. In a preferred aspect, the detergent compositions according to the invention are phosphate-free and/or substantially phosphorus-free as containing less than about 0.5 wt-% phosphorus.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Compositions

According to an embodiment of the invention, alkaline detergents incorporate vinylidene diphosphonic acid polymers. In an aspect, the alkaline detergents comprise, consist of and/or consist essentially of vinylidene diphosphonic acid polymers and a source of alkalinity. In a further aspect, the alkaline detergents comprise, consist of and/or consist essentially of vinylidene diphosphonic acid polymers, an alkali metal hydroxide and/or an alkali metal carbonate, and a threshold agent polymer. The compositions may also include water, surfactants and/or other polymers, oxidizers, etch protectants, additional functional ingredients and/or any combination of the same.

Examples of suitable formulations for detergent compositions according to the invention is shown below:

| | Formulations | | | |
|---|---|---|---|---|
| Water | 0-90 wt-% | 0.1-50 wt-% | 1-20 wt-% | 5-20 wt-% |
| Alkalinity Source | 1-90 wt-% | 20-90 wt-% | 30-80 wt-% | 40-75 wt-% |
| Vinylidene Diphosphonic Acid Polymers | 0.01-50 wt-% | 0.1-50 wt-% | 1-40 wt-% | 2.5-25 wt-% |
| Threshold Agent(s) | 0-40 wt-% | 0-30 wt-% | 0.1-25 wt-% | 0.1-10 wt-% |
| Surfactant(s) | 0-40 wt-% | 0-30 wt-% | 0-25 wt-% | 0-10 wt-% |
| Additional Agents | 0-40 wt-% | 0-30 wt-% | 0-25 wt-% | 0-20 wt-% |

An example of a suitable detergent use solution composition for use according to the invention may comprise, consist and/or consist essentially of about from about 10-1500 ppm of an alkalinity source, from about 1-1000 ppm vinylidene diphosphonic acid polymers, and from about 1-500 ppm of a threshold agent polymer. A further example of a suitable detergent use solution composition may comprise, consist and/or consist essentially of about from about 100-1500 ppm of an alkalinity source, from about 10-500 ppm vinylidene diphosphonic acid polymers, and from about 1-500 ppm of a threshold agent. In a further aspect the detergent use solution has a pH of about 9 and 12.5.

Use solutions of the concentrated detergent compositions according to the embodiments of the invention have a pH greater than about 9. In further aspects, the pH of the detergent composition use solution is between about 9 and 13, or preferably between about 9 and 12.5. In preferred aspects, the pH of the detergent composition use solution is between about 10.5 and 12.5. Beneficially, the detergent compositions of the invention provide effective prevention of hardness scale accumulation on treated surfaces at such alkaline pH conditions. Without being limited to a particular theory of the invention, it is unexpected to have effective cleaning without the accumulation of hardness scaling at alkaline conditions above pH of about 9, namely wherein alkalinity sources (e.g. alkali metal hydroxide) are employed in the detergent composition. In comparison to prior compositions in the art employing vinylidene diphosphonic acid polymers in acidic conditions, the alkaline conditions according to the present invention would expect to result in accumulation of hardness scaling, as opposed to the prior art acidic conditions, wherein calcium carbonate and other hardness ions would not result in scaling. Accordingly, it is highly unexpected the vinylidene diphosphonic acid polymers would be effective for controlling calcium carbonate scale at high pH and high temperature in cleaning applications.

Vinylidene Diphosphonic Acid Polymers

The detergent compositions according to the invention employ vinylidene diphosphonic acid polymers. Vinylidene diphosphonic acid polymers may also be described as vinyl phosphonic acid polymers. In a preferred aspect of the invention, the vinylidene diphosphonic acid polymers are unsaturated monocarboxylic acid polymers and/or copolymers with a phosphonate end group, preferably a vinylidene diphosphonic acid end group. A vinylidene diphosphonic acid polymer and/or copolymer may also be referred to as vinylidene-1,1-di-phosphonic acid polymer. In an aspect of the invention, the vinylidene diphosphonic acid polymers may be a combination of mono-, bis- and oligomeric vinylidene diphosphonic acid adducts.

In an aspect of the detergent compositions according to the invention, a water soluble polymer chain, preferably an unsaturated monocarboxylic acid polymer and/or copolymer with a phosphonate end group has the following general structure:

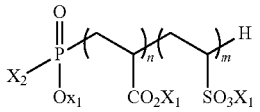

where in $X_1$ is selected from $Na^+$ and $K^+$, and $X_1$ can be a combination of $Na^+$ and $K^+$. The mole ratio of n:m is from about 5:1 to about 1:5, preferably from about 3:1 to about 1:3. $X_2$ has the following structure:

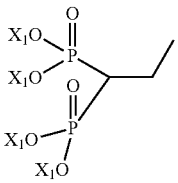

wherein $X_1$ is selected from $Na^+$ and $K^+$, where $X_1$ can be $Na^+$ and/or $K^+$.

In additional aspects, n is an integer between 1-150, preferably between 20-100, and more preferably between 30-75 and wherein m is an integer between 1-150, preferably between 20-100, and more preferably between 30-75. The mole ratio of n:m is from about 5:1 to 1:5, from about 4:1 to 1:4, more preferable between about 3:1 to 1:3 and most preferably between about 2:1 to 1:2.

Beneficially according to the invention, without being limited to a particular theory and/or mechanism of action, the phosphonate end groups, preferably vinylidene diphosphonic acid end group, on the polymers of the invention provide improved attachment to surfaces, including those of stains and soils, in comparison to other polymers. As a result, the polymer provides both improved cleaning through the prevention of soil accumulation and redeposition on surfaces, as well as the mitigation of hard water scale. Such polymers have been used as, or in connection with, flame-retardants, cements, metal pre-treatments for paint applications, and ion exchange resins; however, use in combination with alkaline detergents, particularly alkali metal hydroxide-containing alkaline detergents, for providing hard water scale control and prevention of soil accumulation and redeposition have not previously been identified.

In an aspect, the vinylidene diphosphonic acid polymer may include one or more of polymers, copolymers and/or homopolymers having monomeric units derived from ethylenically unsaturated monomers. In a further aspect the ethylenically unsaturated monomers are water soluble (or partially water soluble). In a still further aspect the ethylenically unsaturated monomers are have an anionic substituent group, such as the preferred phosphonate end group, including the vinylidene diphosphonic acid end group. Suitable ethylenically unsaturated monomers include, for example, vinyl sulfonate, acrylic acid, methacrylic acid, maleic acid, and the fully or partly neutralized salts of said acids. In a preferred aspect, the end groups are selected from vinyl sulfonate and acrylic acid.

Exemplary polymers, copolymers and/or homopolymers include, for example, allyl sulfonate and acrylic acid copolymer with a vinylidene diphosphonic acid end group (or salt thereof), sulfonated copolymers and/or homopolymers of acrylic acid, methacrylic acid and/or maleic acid with a vinylidene diphosphonic acid end group, sulfonated copolymer of acrylic acid and vinylidene-1,1-di-phosphonic acid (or vinylidene diphosphonic acid or salt thereof), sulfonated copolymers of acrylic acid and salt of vinylidene-1,1-diphosphonic acid (or vinylidene diphosphonic acid), sulfonated copolymers of maleic acid and vinylidene-1,1-diphosphonic acid (or vinylidene diphosphonic acid or salt thereof), sulfonated cross-linked copolymers of acrylic acid and/or maleic acid and vinylidene-1,1-di-phosphonic acid (or vinylidene diphosphonic acid or salt thereof), or the like.

The polymers employed according to the alkaline detergent compositions of the present invention do not include amides and/or monomers having the general formulas $—CONR_1R_2$ and/or $—CH_2{=}CR_1—CONR_2R_3$. As set forth above, the monomer unit is a ethylenically unsaturated monomer. Accordingly, nitrogen containing monomers are excluded from the monomers suitable for use according to the alkaline detergent compositions. Specifically, amides with sulfonate groups, including for example, 2-acrylamido 2-methylpropane sulfonic acid (AMPS) are excluded from the monomers suitable for use according to the alkaline detergent compositions, such as those disclosed for example in the U.S. Pat. No. 7,674,382.

Additional description of suitable vinylidene diphosphonic acid polymers and/or methods of making the same for use as the vinylidene diphosphonic acid polymers of the present invention is provided in U.S. Pat. Nos. 3,686,290, 3,576,793, 7,915,204, and 8,003,575, each of which are incorporated herein by reference in their entirety.

In preferred aspects, the unsaturated monocarboxylic acid polymers and/or copolymers with a phosphonate end group, preferably a vinylidene diphosphonic acid end group, are commercially available. In an aspect, a preferred vinylidene diphosphonic acid polymer is available under the tradename Aquarite ESL, which is a copolymer of allyl sulfonate and acrylic acid with vinylidene diphosphonic acid end group (available from Rhodia).

In aspects of the invention the detergent composition is nitrilotriacetic acid (NTA)-free to meet certain regulations. In additional aspects of the invention the detergent composition is substantially phosphate free or phosphate-free to meet certain regulations. In additional aspects of the invention the detergent composition is a low phosphorous detergent, including for example, a detergent composition containing less than about 0.5 wt-% phosphorous to meet certain regulations. Accordingly, it is a benefit of the detergent compositions of the present invention to provide detergent compositions capable of controlling (i.e. preventing) hardness scale accumulation and soil accumulation and redeposition on a substrate surface without the use of phosphates (or low phosphate), such as tripolyphosphates including sodium tripolyphosphate, commonly used in detergents to prevent hardness scale and/or accumulation.

The vinylidene diphosphonic acid polymers of the claimed invention may be provided in a detergent composition according to the invention in amounts between about 0.01% to about 50% by weight, about 0.1% to about 50% by weight, about 1% to about 40% by weight, or about 2.5% to about 25% by weight, whether provided as a concentrate or as a use composition. Without being limited according to embodiments of the invention, all recited ranges for the vinylidene diphosphonic acid polymers are inclusive of the numbers defining the range and include each integer within the defined range.

Alkalinity Source

According to an embodiment of the invention, the detergent compositions include at least one alkalinity source.

Exemplary alkalinity sources include alkali metal carbonates and/or alkali metal hydroxides. In various aspects, a combination of both alkali metal carbonates and/or alkali metal hydroxides are employed as the alkalinity source. In a preferred aspect, the alkalinity source consists essentially of and/or consists of an alkali metal hydroxide.

Alkali metal hydroxides used in the formulation of detergents are often referred to as caustic detergents. Examples of suitable alkali metal hydroxides include sodium hydroxide, potassium hydroxide, and lithium hydroxide. Exemplary alkali metal salts include sodium carbonate, potassium carbonate, and mixtures thereof. The alkali metal hydroxides may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution.

Alkali metal carbonates used in the formulation of detergents are often referred to as ash-based detergents and most often employ sodium carbonate. Additional alkali metal carbonates include, for example, sodium or potassium carbonate. In aspects of the invention, the alkali metal carbonates are further understood to include metasilicates, silicates, bicarbonates and sesquicarbonates. According to the invention, any "ash-based" or "alkali metal carbonate" shall also be understood to include all alkali metal carbonates, metasilicates, silicates, bicarbonates and/or sesquicarbonates.

The alkalinity source may be a single source or more than one sources. In addition to the first alkalinity source (e.g. alkali metal carbonate and/or hydroxide), the detergent composition may comprise a secondary alkalinity source. Examples of useful secondary alkaline sources include, but are not limited to: metal silicates such as sodium or potassium silicate or metasilicate; metal carbonates such as sodium or potassium carbonate, bicarbonate, sesquicarbonate; metal borates such as sodium or potassium borate; and ethanolamines and amines. Such alkalinity agents are commonly available in either aqueous or powdered form, either of which is useful in formulating the present detergent compositions.

An effective amount of one or more alkalinity sources is provided in the detergent composition. An effective amount is referred to herein as an amount that provides a use composition having a pH of at least about 9, preferably from about 9 to about 12.5, or preferably at least about 10. When the use composition has a pH of between about 9 and about 10, it can be considered mildly alkaline, and when the pH is greater than about 12, the use composition can be considered caustic. In some circumstances, the detergent composition may provide a use composition that is useful at pH levels below about 9, such as through increased dilution of the detergent composition.

Threshold Agents

According to an embodiment of the invention, the detergent compositions preferably include a threshold agent or a threshold agent polymer. As used herein, the term "threshold agent" refers to a compound that inhibits crystallization of water hardness ions from solution, but that need not form a specific complex with the water hardness ion. Threshold agents are capable of maintaining hardness ions in solution beyond its normal precipitation concentration. See e.g., U.S. Pat. No. 5,547,612. According to preferred embodiments, threshold agents are water soluble polymeric systems capable of preventing hard water scale formation. According to the invention, the threshold agents are compatible for inhibiting scaling caused by hard water deposits, particularly in systems supplied with water having high levels of carbonate, hydroxide and/or phosphate ions along with water hardness ions traditionally leading to buildup causing unsightly residue, film and scaling. In many aspects, the use of a threshold agent obviates the need to "soften" a water source for use with the alkaline detergent compositions according to the invention.

In an aspect according to the invention, threshold agents may include, for example and without limitation various low molecular weight polymers including, polycarboxylates, such as polyacrylates, polymethacrylates, olefin/maleic copolymers, olefin/acrylate copolymers and the like. In a further aspect, threshold agents may include phosphonates.

In an aspect, particularly suitable threshold agents include polycarboxylates or related copolymers. A variety of such polycarboxylate polymers and copolymers are known and described in patent and other literature, and are available commercially. Exemplary polycarboxylates that may be utilized as threshold agents according to the invention include for example: homopolymers and copolymers of polyacrylates; polymethacrylates; polymalates; materials such as polyolefinic and polymaleic copolymers, such as olefinic and maleic hydride copolymers and also olefinic and acrylate copolymers and derivatives and salts of all of the same. In one embodiment, the threshold agent is a polymer with a natural backbone such as a cellulosic, polysaccharide-based, or alginic-based polymer and copolymer and derivatives and salts of all of the same.

Although not intending to be limited according to a particular theory, the threshold agents suitable for use according to the present invention are preferably short chain polymers with low molecular weights that do not cause decreased chlorine production or increased voltage demand as a result of a large molecular weight and long chain interfering with electrical flow in an electrochemical cell. According to an embodiment of the invention, suitable threshold agents have a molecular weight less than 10,000, preferably less than 5000, more preferably less than 4000, and according to a most preferred embodiment less than 2000.

According to preferred embodiments, the threshold agent for use in combination with the vinylidene diphosphonic acid polymers in the alkaline detergent compositions may be selected from the following commercially-available agents: Acusol 445N, Acusol 588, Acusol 455, Acusol 420NG, Acusol 445ND, Acusol 445NG, Acusol 460NK, Acusol 497NG, Acusol 2100, Acusol 3100 (all available from Rohm & Haas), Bayhibit AM (available from Lanxess), Belclene 200 (available from BWA Water Additives), Briquest 301-50A, Briquest ADPA-60A, Briquest 422-25S, Briquest 422-34CS, Briquest 301-50A, Briquest 543-45AS, Briquest 543-25S, Briquest ADPA-20AS, Briquest ADPA-21SH, Briquest 221-50A, Briquest 301-50A, Briquest 5123-50A (all available from Rhodia) and Aquatreat AR 260 (available from Alco Chemical). Various other commercially-available threshold agents may also be employed.

The threshold agents can be provided at a concentration up to about 10,000 ppm to achieve a desired level of scale inhibition. According to preferred embodiments, the threshold agent can be provided at a concentration up to about 1,000 ppm, from about 50 to about 500 ppm, and preferably about 100 ppm. Without being limited according to the invention, the range of threshold agent concentration further includes the numbers defining the range and each integer within the defined range.

Additional Functional Ingredients

The components of the detergent composition can be combined with various additional functional ingredients. In some embodiments, the alkaline detergent composition including the vinylidene diphosphonic acid polymer and alkalinity source(s) make up a large amount, or even substantially all of the total weight of the detergent composition, for example, in embodiments having few or no additional functional ingredients disposed therein. In other embodiments, the alkaline detergent composition including the vinylidene diphosphonic acid polymer, alkalinity source(s) and threshold agent make up a large amount, or even substantially all of the total weight of the detergent composition. In still further aspects, the compositions further include water. In these embodiments, the component concentration ranges provided above for the detergent composition are representative of the ranges of those same components in the detergent composition.

In other aspects, the detergent compositions include vinylidene diphosphonic acid polymer, alkali metal carbonate and/or alkali metal hydroxide alkalinity source(s), threshold active polymer(s), water, and additional functional ingredient(s). The functional ingredients provide desired properties and functionalities to the alkaline detergent composition. For the purpose of this application, the term "functional ingredients" includes an ingredient that when dispersed or dissolved in a use and/or concentrate, such as an aqueous solution, provides a beneficial property in a particular use, namely warewash applications. Some particular examples of functional ingredients are discussed in more detail below, although the particular materials discussed are given by way of example only, and that a broad variety of other functional ingredients may be used. For example, many of the functional ingredients discussed below relate to materials used in ware wash cleaning applications.

Exemplary additional functional ingredients include for example: builders or water conditioners, including detergent builders; hardening agents; bleaching agents; fillers; defoaming agents; anti-redeposition agents; stabilizing agents; dispersants; glass and metal corrosion inhibitors; oxidizers; chelants; fragrances and dyes; thickeners; etc. Further description of suitable additional functional ingredients is set forth in U.S. patent application Ser. No. 12/977,340, which is incorporated herein by reference in its entirety.

Surfactants

In some aspects according to the invention, the alkaline detergent compositions do not include surfactants. In certain embodiments of the invention the detergent composition does not require a surfactant in addition to the vinylidene diphosphonic acid polymers and/or threshold agents.

In other aspects the alkaline detergent compositions of the present invention include at least one surfactant. Surfactants suitable for use with the compositions of the present invention include, but are not limited to, nonionic surfactants, cationic surfactants, amphoteric surfactants and/or zwitterionic surfactants. In some embodiments, the compositions of the present invention include about 0-40 wt-% of a surfactant. In other embodiments the compositions of the present invention include about 0-25 wt-% of a surfactant.

Description of surfactants suitable for use according to the present invention is found in U.S. Pat. Nos. 8,481,473, 8,480,808, 8,263,540, 8,110,537, and 8,063,010, which are exemplary disclosures of alkaline detergent compositions which may optionally include surfactants and which are herein incorporated by reference in their entirety.

In alternative embodiments, the detergent compositions employ at least one surfactant, such as a nonionic surfactant to provide defoaming properties to the composition. In a further embodiment, the detergent compositions employ at least one nonionic surfactant and an additional surfactant.

Nonionic Surfactants

Suitable nonionic surfactants which may be suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic® and reverse Pluronic® surfactants; alcohol alkoxylates; capped alcohol alkoxylates; mixtures thereof, or the like.

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Block polyoxypropylene-polyoxyethylene polymeric compounds based upon propylene glycol, ethylene glycol, glycerol, trimethylolpropane, and ethylenediamine as the initiator reactive hydrogen compound are suitable nonionic surfactants. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Semi-Polar Nonionic Surfactants

The semi-polar type of nonionic surface active agents are another class of nonionic surfactant which may be useful in compositions of the present invention. Semi-polar nonionic surfactants include the amine oxides, phosphine oxides, sulfoxides and their alkoxylated derivatives.

Amine oxides are tertiary amine oxides corresponding to the general formula:

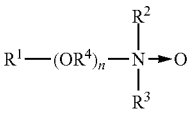

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful semi-polar nonionic surfactants also include the water soluble phosphine oxides having the following structure:

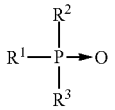

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants useful herein also include the water soluble sulfoxide compounds which have the structure:

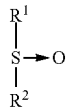

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms. Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Alkoxylated amines or, most particularly, alcohol alkoxylated/aminated/alkoxylated surfactants are also suitable for use according to the invention. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants.

Detergent Builders

In some aspects according to the invention, the alkaline detergent compositions do not include a builder. However, in other aspects the composition can include one or more building agents, also called chelating or sequestering agents (e.g., builders), including, but not limited to: condensed phosphates, alkali metal carbonates, phosphonates, aminocarboxylic acids, aminocarboxylates and their derivatives, ethylenediamine and ethylenetriamine derivatives, hydroxyacids, and mono-, di-, and tri-carboxylates and their corresponding acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. In a preferred embodiment, the detergent composition does not comprise a phosphate builder and remains a phosphate-free detergent composition.

Other chelating agents include nitroloacetates and their derivatives, and mixtures thereof. Examples of aminocarboxylates include amino acetates and salts thereof. Suitable amino acetates include: N-hydroxyethylaminodiacetic acid; hydroxyethylenediaminetetraacetic acid; nitrilotriacetic acid (NTA); ethylenediaminetetraacetic acid (EDTA); N-hydroxyethyl-ethylenediaminetriacetic acid (HEDTA); tetrasodium ethylenediaminetetraacetic acid (EDTA); diethylenetriaminepentaacetic acid (DTPA); and alanine-N,N-diacetic acid; n-hydroxyethyliminodiacetic acid; and the like; their alkali metal salts; and mixtures thereof. Suitable aminophosphates include nitrilotrismethylene phosphates and other aminophosphates with alkyl or alkaline groups with less than 8 carbon atoms. Exemplary polycarboxylates iminodisuccinic acids (IDS), sodium polyacrylates, citric acid, gluconic acid, oxalic acid, salts thereof, mixtures thereof, and the like. Additional polycarboxylates include citric or citrate-type chelating agents, polymeric polycarboxylate, and acrylic or polyacrylic acid-type chelating agents. Additional chelating agents include polyaspartic acid or co-condensates of aspartic acid with other amino acids, $C_4$-$C_{25}$-mono-or-dicarboxylic acids and $C_4$-$C_{25}$-mono-or-diamines. Exemplary polymeric polycarboxylates include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent.

Preferable levels of addition for builders that can also be chelating or sequestering agents are between about 0% to about 70% by weight, about 0.1% to about 60% by weight, or about 1.5% to about 50% by weight. If the solid composition is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Formulations

The alkaline detergent compositions according to the invention may be formulated into solids, liquids, powders, pastes, gels, etc. In preferred aspects, the alkaline detergent compositions according to the invention are solid compositions.

Solid detergent compositions provide certain commercial advantages for use according to the invention. For example, use of concentrated solid detergent compositions decrease shipment costs as a result of the compact solid form, in comparison to bulkier liquid products. In certain embodiments of the invention, solid products may be provided in the form of a multiple-use solid, such as, a block or a plurality of pellets, and can be repeatedly used to generate aqueous use solutions of the detergent composition for multiple cycles or a predetermined number of dispensing cycles. In certain embodiments, the solid detergent compositions may have a mass greater than about 5 grams, such as for example from about 5 grams to 10 kilograms. In certain embodiments, a multiple-use form of the solid detergent composition has a mass of about 1 kilogram to about 10 kilogram or greater.

Concentrate and/or ready-to-use aqueous compositions provide certain commercial advantages for use according to the invention. For example, use of concentrated aqueous detergent compositions are diluted within a warewash machine and do not require initial dilution by a user. These and other beneficial aspects of formulating the alkaline detergent compositions are included within the scope of the present invention.

Methods of Use

The compositions of the invention are suitable for use in various applications and methods, including any application suitable for an alkaline detergent composition.

Preventing Hard Water Scale

The methods of the invention are particularly suited for methods employing alkaline detergents in need of preventing hard water scale accumulation on surfaces. In addition, the methods of the invention are well suited for controlling water hardness buildup on a plurality of surfaces. The methods of the invention prevent moderate to heavy accumulation hardness on treated substrate surfaces beneficially improving the aesthetic appearance of the surface. In certain embodiments, surfaces in need of hard water scale accumulation prevention, include for example, plastics, metal and/or glass surfaces.

The methods of the invention beneficially reduce the formation, precipitation and/or deposition of hard water scale, such as calcium carbonate, on hard surfaces contacted by the detergent compositions. In an embodiment, the detergent compositions are employed for the prevention of formation, precipitation and/or deposition of hard water scale on articles such as glasses, plates, silverware, etc. The detergent compositions according to the invention beneficially provide such prevention of formation, precipitation and/or deposition of hard water scale despite the high alkalinity of the detergent composition use solutions in the presence of hard water.

Preventing and/or Minimizing Soil Accumulation

The methods of the invention are particularly suited for methods employing alkaline detergents in need of preventing soil accumulation, such as food soils, on surfaces. Soil accumulation is detrimental to surfaces used in detergent cleaning applications as it may result in the formation of build up or accumulation having distinct soiled appearance and/or bad odors, in addition to the soil particles covering a surface. The methods of the invention are well suited for preventing soil accumulation on a plurality of surfaces. The methods of the invention reduce and/or substantially eliminate soil accumulation on treated surfaces, such as the inside of a ware wash machine (e.g. filter/pipes/racks/plastic or metal items) and kitchenware including, but not limited to glass, metal, rubber or plastic substrates such as, but not limited to cake pans, baking sheets, molds, loaf pans, muffin pans, pie pans, measuring cups/spoons, saucers, servers, gravy boats, serving bowls, platters, butter dishes, tureens, griddles, glasses, cups, plates, bowls, pots, pans, kitchen utensils and the like. In certain embodiments, hard surfaces in need of prevention of soil accumulation include for example, dish machines, ware wash machines, textile and/or laundry machines, and the like.

The methods of the invention beneficially reduce the redeposition of soils removed from substrate surfaces treated in such machines from adhering to the hard surfaces leaving a soiled, discolored and/or otherwise unacceptable deposit after a cleaning cycle. In an embodiment, the detergent compositions are employed for the prevention of soil accumulation on such hard surfaces found within machines used for cleaning various articles such as glasses, plates, silverware, laundry, etc.

In an aspect, the methods according to the invention provide enhanced soil accumulation prevention and/or hard water scaling over conventional phosphate-based alkaline detergents and detergents having substantially more than 0.5 wt-% phosphorous in the detergent composition, such as those containing tripolyphosphates. In further aspects, the methods according to the invention provide enhanced soil accumulation prevention and/or hard water scaling over conventional threshold-agent containing alkaline detergents, such as those containing acrylic acid polymers. For example, in some aspects, the soil accumulation is reduced by at least about 10% in comparison to conventional phosphate-based alkaline detergents, preferably at least about 20% in comparison to conventional phosphate-based alkaline detergents, or greater. In still a further aspect, the methods according to the invention provide at least substantially similar (e.g. meet performance) soil accumulation prevention in comparison to phosphate-free alkaline detergents that do not contain the vinylidene diphosphonic acid polymers according to the invention. In a still further aspect, the methods according to the invention provide at least substantially similar soil accumulation and/or hard water scale control in comparison to acrylic acid (or other threshold agent containing) detergents that do not contain the vinylidene diphosphonic acid polymers according to the invention.

In an aspect, the methods of cleaning, including reducing soil accumulation and preventing hard water scale accumulation include contacting a hard surface with an alkaline detergent composition, wherein the detergent composition comprises, consists of and/or consists essentially of (a) an alkali metal carbonate and/or alkali metal hydroxide, (b) a vinylidene diphosphonic acid polymer and/or (c) a threshold agent compound, such as a polyacrylic acid, polymaleic acid, phosphonate or the like, wherein the pH of the use solution is from about 9 to about 12.5. Preferably, the contacting step with the detergent composition is during a washing step of a wash cycle. Still more preferably, the contacting of the detergent compositions occurs regularly in the wash cycle of a machine.

The invention generally relates to a method of preventing soil accumulation on hard surfaces and/or preventing hard water scale accumulation on hard surfaces. Various embodiments of the method may comprise at least a first alkaline step. In some aspects, an acidic step may be employed. In another embodiment, the method may include additional alkaline and/or acidic steps in a warewashing application. The method may include an optional prewash step prior to the first alkaline step. In yet another embodiment, the method may include pauses between steps, as well as rinses between or after steps. In a preferred aspect, the methods of reducing soil accumulation and/or preventing hard water scale accumulation include contacting a hard surface with the detergent composition, and thereafter contacting the treated hard surface with a rinse aid composition comprising at least one nonionic surfactant.

In a preferred embodiment, the method includes a pause after the application of the alkaline detergent to the hard surface. In embodiments where alkaline and acidic steps are employed there may be multiple pauses, for example, the method may proceed according to the following: first alkaline step, first pause, first acidic step, second pause, second alkaline step, third pause, and so on. During a pause, no further detergent or other cleaning agent is applied to the hard surface and the existing detergent or cleaning agent is allowed to stand on the surface for a period of time.

The time for each step in the method may vary depending on the dish machine, for example if the dish machine is a consumer dish machine or an institutional dish machine. The time required for a cleaning step in consumer dish machines is typically about 10 minutes to about 60 minutes. The time required for the cleaning cycle in a U.S. or Asian institutional dish machine is typically about 45 seconds to about 2 minutes, depending on the type of machine. Each method step preferably lasts from about 2 seconds to about 30 minutes. Methods of use employing the detergent compositions according to the invention are particularly suitable for institutional ware washing. Exemplary disclosure of warewashing applications is set forth in U.S. patent application Ser. Nos. 13/474,771, 13/474,780, 13/112,412 and 13/527,487, and U.S. Pat. No. 8,092,613, including all references cited therein, which are herein incorporated by reference in its entirety. The method may be carried out in any consumer or institutional dish machine, including for example those described in U.S. Pat. No. 8,092,613, which is incorporated herein by reference in its entirety, including all figures and drawings. Some non-limiting examples of dish machines include door machines or hood machines, conveyor machines, undercounter machines, glasswashers, flight machines, pot and pan machines, utensil washers, dump and fill machines, and consumer dish machines. The dish machines may be either single tank or multi-tank machines.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The detergent compositions are further effective at preventing hard water scale accumulation in warewashing applications using a variety of water sources, including hard water. In addition, the detergent compositions are effective at preventing and/or reducing food soil accumulation on hard surfaces in warewashing applications using a variety of water sources, including hard water. The detergent compositions are suitable for use at temperature ranges typically used in industrial warewashing applications, including for example from about 110° F. to about 175° F. during washing steps and from about 110° F. to about 185° F. during rinsing steps.

The methods of use of the detergent compositions may also be suitable for CIP and/or COP processes to replace the use of bulk detergents leaving hard water residues on treated surfaces and/or leaving soil accumulation on treated surfaces. The methods of use may be desirable in additional applications where industrial standards are focused on the quality of the treated surface and/or the hard surfaces comprising the machinery or components wherein the surfaces are treated, such that the prevention of hard water scale build up and the reduction of soil accumulation provided by the detergent compositions of the invention are desirable. Such applications may include, but are not limited to, vehicle care, industrial, hospital and other health care, water care and textile care.

Additional examples of applications of use for the detergent compositions include, for example, alkaline detergents effective as grill and oven cleaners, ware wash detergents, laundry detergents, laundry presoaks, drain cleaners, hard surface cleaners, surgical instrument cleaners, transportation vehicle cleaning, vehicle cleaners, dish wash presoaks, dish wash detergents, beverage machine cleaners, concrete cleaners, building exterior cleaners, metal cleaners, floor finish strippers, degreasers and burned-on soil removers. In a variety of these applications, cleaning compositions having a very high alkalinity are most desirable and efficacious, however the damage caused by hard water scale accumulation is undesirable.

The various methods of use according to the invention employ the use of the detergent composition, which may be formed prior to or at the point of use by combining the vinylidene diphosphonic acid polymers, alkalinity source and other desired components (e.g. threshold agents) in the weight percentages disclosed herein. The detergent composition may be provided in various formulations. The methods of the invention may employ any of the formulations disclosed, including for example, liquids, semi-solids and/or other solid formulations, such as those set forth according to the description of formulations according to the invention.

The methods of the invention may also employ a concentrate and/or a use solution constituting an aqueous solution or dispersion of a concentrate. Such use solutions may be formed during the washing process such as during warewashing processes.

In aspects of the invention employing packaged solid detergent compositions, the products may first require removal from any applicable packaging (e.g. film). Thereafter, according to certain methods of use, the compositions can be inserted directly into a dispensing apparatus and/or provided to a water source for cleaning according to the invention. Examples of such dispensing systems include for example U.S. Pat. Nos. 4,826,661, 4,690,305, 4,687,121, 4,426,362 and U.S. Pat. Nos. Re 32,763 and 32,818, the disclosures of which are incorporated by reference herein in its entirety. Ideally, a solid detergent composition is configured or produced to closely fit the particular shape(s) of a dispensing system in order to prevent the introduction and dispensing of an incorrect solid product into the apparatus of the present invention.

In certain embodiments, the detergent composition may be mixed with a water source prior to or at the point of use. In other embodiments, the detergent compositions do not require the formation of a use solution and/or further dilution and may be used without further dilution.

In aspects of the invention employing solid detergent compositions, a water source contacts the detergent composition to convert solid detergent compositions, particularly powders, into use solutions. Additional dispensing systems may also be utilized which are more suited for converting alternative solid detergents compositions into use solutions. The methods of the present invention include use of a variety of solid detergent compositions, including, for example, extruded blocks or "capsule" types of package.

In an aspect, a dispenser may be employed to spray water (e.g. in a spray pattern from a nozzle) to form a detergent use solution. For example, water may be sprayed toward an apparatus or other holding reservoir with the detergent composition, wherein the water reacts with the solid detergent composition to form the use solution. In certain embodiments of the methods of the invention, a use solution may be configured to drip downwardly due to gravity until the dissolved solution of the detergent composition is dispensed for use according to the invention. In an aspect, the use solution may be dispensed into a wash solution of a ware wash machine.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting examples. It should be understood that these examples, while indicating certain embodiments of the invention, are given by way of illustration only. From the above discussion and the examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Hard water film accumulation testing was conducted using a light box evaluation of 100 cycle glasses. The 100 cycle experiment was performed using six 10 oz. Libby glasses on a Hobart AM-15 ware wash machine employing 17 grain water (hard water source). Initially the glasses were prepared using a cleaning cycle to completely remove all film and foreign material from the glass surface.

The Example compositions shown in Table 1 were evaluated. The controls employed were a commercially-available alkali metal detergent composition (Solid Power XL, available from Ecolab, Inc.) (Control 1) and a Negative Control (shown below in Table 1).

TABLE 1

| Raw material | Negative Control | Ex 1 | Ex 2 | Ex 3 |
|---|---|---|---|---|
| Water | 25 | 4 | 11.5 | 11.5 |
| Sodium hydroxide (beads) | 75 | 66 | 66 | 66 |
| Vinylidene diphosphonic acid polymer | 0 | 30 | 15 | 15 |
| Threshold Agent Polymer - Bayhibit AM (50%) | 0 | 0 | 7.5 | 0 |
| Threshold Agent Polymer - Belclene 200 (50%) | 0 | 0 | 0 | 7.5 |

The vinylidene diphosphonic acid polymer and threshold agents employed are commercially available from the following sources.

Aquarite ESL (25%) is a copolymer of allyl sulfonate and acrylic acid with vinylidene diphosphonic acid end group (available from Rhodia).

Bayhibit AM (50%) is a 2-phosphonobutane-1,2,4-tricarboxylic acid (available from Lanxess).

Belclene 200 (50%) is a polymaleic acid (available from BWA Water Additives).

The ware wash machine controller was set to automatically dispense the indicated amount of detergent into the wash tank. Six clean glasses (G=glass tumblers) were placed in a Raburn rack (see figure below for arrangement) and the rack was placed inside the dishmachine.

G G G G G P G

-continued

The ware wash machine automatically dispensed into the ware wash machine the detergent compositions to achieve the desired concentration and maintain the initial concentration. The glasses were dried overnight and then the film accumulation using a strong light source was evaluated.

The light box test standardizes the evaluation of the glasses run in the 100 cycle test. The light box test is based on the use of an optical system including a photographic camera, a light box, a light source and a light meter. The system is controlled by a computer program (Spot Advance and Image Pro Plus). To evaluate the glasses after the 100 cycle test, each glass was placed on the light box resting on its side and the intensity of the light source was adjusted to a predetermined value using a light meter. The conditions of the 100 cycle test were entered into the computer. A picture of the glass was taken with the camera and saved on the computer for analysis by the program. The picture was analyzed using the upper half of the glass in order to avoid the gradient of darkness on the film from the top of the glass to the bottom of the glass, based on the shape of the glass.

Generally, a lower light box rating indicates that more light was able to pass through the glass. Thus, the lower the light box rating, the more effective the composition was at preventing scaling on the surface of the glass. Light box evaluation of a clean, unused glass has a light box score of approximately 12,000 which corresponds to a score of 72,000 for the sum of 6 glasses. Table 2 shows the results of the light box test.

TABLE 2

| | Use | Light Box Scores | | |
|---|---|---|---|---|
| Example | Concentration | Glasses | Plastic | Sum |
| Negative Control | 660 ppm | 393120 | 65535 | 458745 |
| Control 1 | 750 ppm | 151423 | 59834 | 211257 |
| Example 1 | 750 ppm | 204416 | 53003 | 247419 |
| Example 2 | 750 ppm | 154192 | 47054 | 201246 |
| Example 3 | 750 ppm | 148243 | 65535 | 213778 |

The results demonstrate that the Examples 1-3 according to embodiments of the invention combining a vinylidene diphosphonic acid yield acceptable light box scores in comparison to the negative control and substantially similar scores a Control 1. The Examples 2-3 containing a threshold agent in addition to the vinylidene diphosphonic acid polymer provide enhanced better light box scores. In addition, according to the invention, the formulations of the detergent compositions do not require the inclusion of any additional surfactants or functional ingredients.

Example 2

The cleaning efficacy of the detergent compositions according to the invention and controls (described above in Table 1) were further evaluated using a 50 cycle antiredeposition experiment for institutional ware wash detergents. To test the ability of compositions to clean glass and plastic, 6 10 oz. Libby heat resistant glass tumblers and 1 plastic tumblers were used. The glass tumblers were cleaned prior to use. New plastic tumblers were used for each experiment.

A food soil solution was prepared using a 50/50 combination of beef stew and hot point soil and employed at 2000 ppm soil. The soil included two cans of Dinty Moore Beef Stew (1360 grams), one large can of tomato sauce (822 grams), 15.5 sticks of Blue Bonnet Margarine (1746 grams) and powered milk (436.4 grams). The hot point soil was added to the machine to maintain a sump concentration of about 2000 ppm.

After filling the dishmachine with 17 grain water, the heaters were turned on. The wash temperature was adjusted to about 150-160° F. The final rinse temperature was adjusted to about 175-190° F. The controller was set to disclose the amount of detergent in the wash tank. The glass and plastic tumblers were placed in the Raburn rack (see figure below for arrangement; P=plastic tumbler; G=glass tumbler) and the rack was placed inside the dishmachine.

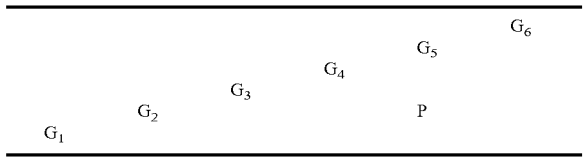

The dishmachine was then started and run through an automatic cycle. At the beginning of each cycle the appropriate amount of hot point sol was added to maintain the sump concentration of 2000 ppm. The detergent concentration is controlled by conductivity.

When the 50 cycles ended, the glasses were allowed to dry overnight. Thereafter they were graded for spots and film accumulation (visual).

The glass and plastic tumblers were then graded for protein accumulation using Commassie Brilliant Blue R stain followed by destaining with an aqueous acetic acid/methanol solution. The Commassie Brilliant Blue R stain was prepared by combining 1.25 g of Commassie Brilliant Blue R dye with 45 mL of acetic acid and 455 mL of 50% methanol in distilled water. The destaining solution consisted of 45% methanol and 10% acetic acid in distilled water.

The amount of protein remaining on the glass and plastic tumblers after destaining was rated visually on a scale of 1 to 5. A rating of 1 indicated no protein was present after destaining—no spots/no film. A rating of 2 indicated that random areas (barely perceptible) were covered with protein after destaining—spots at random (or about 20% surface covered in film). A rating of 3 indicated that about a quarter to half of the surface was covered with protein after destaining (or about 40% surface covered in film). A rating of 4 indicated that about half of the glass/plastic surface was covered with protein after destaining (or about 60% surface covered in film). A rating of 5 indicated that the entire surface was coated with protein after destaining (or at least about 80% surface covered in film).

The ratings of the glass tumblers tested for soil removal were averaged to determine an average soil removal rating from glass surfaces and the ratings of the plastic tumblers tested for soil removal were averaged to determine an average soil removal rating from plastic surfaces. Similarly, the ratings of the glass tumblers tested for redeposition were averaged to determine an average redeposition rating for glass surfaces and the ratings of the plastic tumblers tested for redeposition were averaged to determine an average redeposition rating for plastic surfaces.

The results are shown in Tables 3-4, demonstrating that the detergent compositions according to the invention provide at least substantially similar cleaning efficacy and in various embodiments provide superior efficacy over commercial products.

TABLE 3

| Spotting Scores | G1 | G2 | G3 | G4 | G5 | G6 | P1 | SUM |
|---|---|---|---|---|---|---|---|---|
| Control 1 | 3 | 3 | 3 | 3 | 2.5 | 2 | — | 16.5 |
| EX 1 | — | — | — | — | — | — | — | — |
| EX 2 | 2 | 1.5 | 2.5 | 1.5 | 1.5 | 2.5 | — | 11.5 |
| EX 3 | — | — | — | — | — | — | — | — |

TABLE 4

| Filming Scores | G1 | G2 | G3 | G4 | G5 | G6 | P1 | SUM |
|---|---|---|---|---|---|---|---|---|
| Control 1 | 1.5 | 2 | 2 | 2 | 2 | 2.5 | 4 | 16 |
| EX 1 | 5 | 5 | 5 | 5 | 5 | 5 | 5 | 35 |
| EX 2 | 2 | 1.5 | 2.5 | 1.5 | 1.5 | 2.5 | 5 | 16.5 |
| EX 3 | 4.5 | 4 | 4 | 4 | 4 | 4.5 | 3 | 28 |

The spotting scores from Table 3 were unavailable for EX 1 and EX 3 due to heavy filming on the glasses. However, EX 2 performed well with improved spotting scores over the control.

The filming scores from Table 4 illustrate that EX 2 and EX 3 having the combined vinylidene diphosphonic acid polymer and threshold agent provide beneficial results, wherein EX 3 provides substantially similar filming scores as the commercially available control.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A detergent composition comprising:

an alkalinity source selected from alkali metal carbonate and alkali metal hydroxide;

a nonionic surfactant; and a polymer with the following structure:

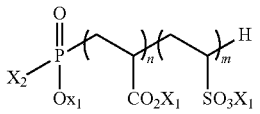

wherein $X_1$ is selected from $Na^+$ and $K^+$ and the mole ratio of n:m is from about 5:1 to about 1:5 and $X_2$ has the following structure:

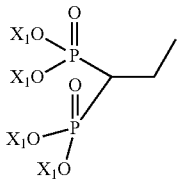

wherein a use solution of the detergent composition has a pH between about 9 and 12.5.

2. The composition of claim 1, wherein the polymer mole ratio of n:m is from about 3:1 to about 1:3.

3. The composition of claim 1, wherein the polymer is an unsaturated monocarboxylic acid with phosphonate end group, wherein the phosphonate end group is an anionic vinylidene diphosphonic acid end group.

4. The composition of claim 1, wherein the polymer comprises vinyl sulfonate and/or acrylic acid groups.

5. The composition of claim 1, further comprising a threshold agent.

6. The composition of claim 5, wherein the use solution comprises from about 100-1500 ppm of an alkalinity source, from about 5-500 ppm of the polymer, and from about 5-500 ppm threshold agent.

7. The composition of claim 1, wherein the detergent is a concentrated solid, liquid, powder, paste, or gel.

8. The composition of claim 1, further comprising water, an oxidizer, an etch protectant, and/or combinations thereof.

9. The composition of claim 1, wherein the detergent composition does not include phosphates and/or has less than 0.5 wt-% phosphorus, and does not include amides or nitrogen containing monomers.

10. A solid detergent composition comprising:

a polymer with the following structure:

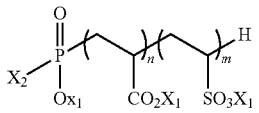

wherein $X_1$ is selected from $Na^+$ and $K^+$ and the mole ratio of n:m is from about 5:1 to about 1:5 and $X_2$ has the following structure:

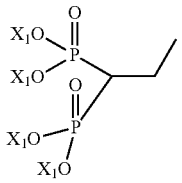

an alkali metal hydroxide and/or alkali metal carbonate alkalinity source;

a threshold agent;

a nonionic surfactant; and water;

wherein a use solution generated from the solid detergent composition has a pH between about 9 and 12.5.

11. The composition of claim 10, wherein the polymer has a polymer mole ratio of n:m from about 3:1 to about 1:3.

12. The composition of claim 10, wherein the polymer is a copolymer of allyl sulfonate and acrylic acid with vinylidene diphosphonic acid end group.

13. The composition of claim 10, wherein the alkalinity source constitutes from about 1-90 wt-% of the detergent composition, the polymer constitutes from about 0.01-50 wt-% of the detergent composition, and the threshold agent constitutes from 0.01-40 wt-% of the detergent composition.

14. A method of reducing soil build up on a hard surface comprising:

contacting a hard surface with a detergent composition comprising an unsaturated monocarboxylic acid polymer with vinylidene diphosphonic acid end group having the formula of the composition of claim 1, an alkali metal hydroxide alkalinity source, a threshold agent, a nonionic surfactant, and water, wherein a use solution of the detergent composition has a pH between about 9 and 12.5, and wherein the detergent composition has less than 0.5 wt-% phosphorus; and reducing and/or preventing soil build up on the hard surface.

15. The method of claim 14, wherein the polymer is a copolymer of allyl sulfonate and acrylic acid with vinylidene diphosphonic acid end group.

16. The method of claim 15, wherein the alkalinity source constitutes from about 1-90 wt-% of the detergent composition, the unsaturated monocarboxylic acid polymer with vinylidene diphosphonic acid end group constitutes from about 0.01-50 wt-% of the detergent composition, and the threshold agent constitutes from 0.01-40 wt-% of the detergent composition.

17. The method of claim 14, further comprises the first step of generating a use solution from a solid detergent composition, wherein the use solution comprises from about 100 ppm to about 1500 ppm of the alkalinity source, from about 5 ppm to about 500 ppm of the unsaturated monocarboxylic acid polymer with vinylidene diphosphonic acid end group, and from about 1 to about 250 ppm of the threshold agent.

18. The method of claim 14, further comprising contacting the hard surface treated with the detergent composition with a rinse aid composition.

19. The method of claim 14, wherein the use solution of the detergent composition contacts the hard surface during the washing step of the wash cycle at a temperature range from about 110° F. to about 175° F.

20. The method of claim 14, wherein the reduction of soil build up is at least about 10%.

* * * * *